US005600995A

United States Patent [19]

Sherman

[11] Patent Number: 5,600,995

[45] Date of Patent: Feb. 11, 1997

[54] USEFUL IMPROVEMENTS IN PRESS APPARATUS

[76] Inventor: Alden O. Sherman, 85 Weston Rd., Weston, Conn. 06883

[21] Appl. No.: 481,069

[22] Filed: Jun. 7, 1995

[51] Int. Cl.[6] ..... B21J 9/18; B21H 7/16

[52] U.S. Cl. ..... 72/451; 72/220

[58] Field of Search ..... 72/207, 220, 451

[56] References Cited

U.S. PATENT DOCUMENTS

| | | | |
|---|---|---|---|
| 1,045,022 | 11/1912 | Hauberg | 72/220 |
| 3,792,602 | 2/1974 | Fukuda | 72/220 |
| 4,483,168 | 11/1984 | Sherman | 72/220 |

FOREIGN PATENT DOCUMENTS

| | | | |
|---|---|---|---|
| 711370 | 9/1941 | Germany | 72/451 |
| 6-179031 | 6/1994 | Japan | 72/220 |
| 573132 | 11/1945 | United Kingdom | 72/451 |

*Primary Examiner*—David Jones
*Attorney, Agent, or Firm*—William G. Rhines, Esq.

[57] ABSTRACT

For use in forming apparatus having a die element and a roll platen element that have parallel, facing, flat, and preferably horizontal surfaces and each of which has an associated mounting structure, toggle assemblies to alter the distance between the flat surfaces of those elements by moving one or both of them, and to positionally fix those surfaces at desired distances from each other. Each toggle assembly includes an obtusely angled toggle link, one end of which is pivotally interconnected with an associated motion actuator means. A second toggle link that is positioned across the exterior angle of the angled toggle link has one end that is pivotally affixed to the angled toggle link at a first pivot point located at the angle of the angled link. The other end of the second toggle link and the other end of the angled toggle link are pivotally interconnected to the element and with its associated mounting structure, in either order, at second and third pivot points. When the element is in its most distant location from the other element, the first pivot point is located at one side of a straight line between said second pivot point and said third pivot point. By actuation of the motion actuator means, the first pivot point is made to move substantially to said line. Optional stop means may be included which limits the ability of the first point to move substantially past said line.

8 Claims, 4 Drawing Sheets

USEFUL IMPROVEMENTS IN PRESS APPARATUS

BACKGROUND OF INVENTION

In my U.S. Pat. No. 4,483,168 which was issued on Nov. 20, 1984, I disclosed new and useful apparatus for forming shaped pieces. One embodiment of that invention which is particularly useful in forming metal parts such as the vanes used in the compressor section of gas turbines, comprises apparatus which includes a flat surfaced die element which includes a workpiece forming depression in or as part of its upper surface. A pair of yoke-mounted cylindrical rolls, oriented with their axes parallel and positioned one above the other, are located between the flat, upper surface of the die element and the flat lower surface of a downward acting roll platen element that is actuated into its backing position and held there by a vertically oriented hydraulic press. The rolls are simultaneously moveable horizontally by means of a horizontally oriented hydraulic ram, the piston rod of which acts upon the yoke mounting of the rolls, while the rolls are in rolling contact with each other and with the upper surface of the die element and the lower surface of the top, roll platen element. By this means, forming stock from which desired vanes or other pieces are to be formed may be retentivity positioned at the location of the depression in the upper surface of the die element while the rolls, while under downward pressure from the vertically oriented hydraulic press acting via the roll platen element, are moved laterally by the horizontally oriented hydraulic ram. By performing one or more successive passes on the work piece, it is possible with this apparatus to form very hard materials into complex, intricate and precise shapes at much lower cost than was possible with the machining techniques previously utilized.

One of the characteristics of this apparatus is that the downward pressure brought to bear on the work piece by the roll set is imparted by the downward thrust of the vertical hydraulic press. As described in my above-referenced prior patent, if the resistance of the work piece to being formed exceeds that applied pressure, the piston of the vertical hydraulic press will be moved upward as the roll set moves across the workpiece. This can have the effect of causing the workpiece not to conform to the required or ultimately desired size and/or shape specifications. While this feature may be advantageous in many applications, in other situations this can be an undesirable effect. For example, as materials typically used to form certain workpieces are of increased resistance to roll formation, the amount of pressure required to resist deflection of the roll set may be much higher than the press is capable of imparting. Therefore the technical difficulties attendant such increasingly high pressure hydraulic equipment may increase radically. Further, localized hard or less malleable areas in the work pieces can produce intolerable deviations in the work piece from applicable specifications.

Thus, in some situations it is desired in performing the forming passes for the vertical position of the rolls vis-a-vis the forming die element not to change substantially, to make it possible for each piece to be formed in a reduced number of passes, and/or to ensure that each piece conforms within acceptable tolerances to applicable dimensional specifications, such as local deviations due to localized changes in resistance to being formed. Further, it is sometimes the case that to maintain the very high pressures that are necessary to form pieces, particularly those made from materials having the reduced malleability that characterizes some of the work stock that is used in such technically difficult applications as turbine vanes, involves imposing stresses on the associated hydraulic equipment that may be so high as to be impractical or intolerable.

Therefore it has been found that in certain applications of this type of equipment, it is acceptable and desirable to fix more or less unyieldingly the position of the roll platen element while the workpiece is being formed, and to do so without having to use hydraulic pressure as the means for maintaining those relationships. It is preferable for this to be done by eliminating the necessity for using such hydraulic equipment altogether to hold the roll platen element and the die element in desired juxtaposition with respect to each other. At the same time, provision must be made for getting at the forming area easily, for such purposes as to install work piece forming stock, to remove workpieces and debris, to change die members, to maintain the equipment, etc.

Accordingly, it is an object of this invention to provide means useful in the roll-forming of objects in desired shapes and dimensions.

Another object of this invention is to provide means which will satisfy the foregoing objective while assuring that deviations from design specifications of the objects so formed will remain within tolerable levels.

Still another object of this invention is to provide means for satisfying one or more of the foregoing objectives while reducing the amount of work necessary during forming operations.

Yet another object of this invention is to provide means for satisfying one or more of the foregoing objectives in which a hydraulic mechanism to maintain vertical closure pressure on the roll platen element is not necessary.

SUMMARY OF INVENTION

In forming apparatus having a die element and a roll platen element that have parallel, facing, flat, and preferably horizontal surfaces and each of which has an associated mounting structure, desired objectives may be achieved through use of toggle assemblies embodying the present invention to alter the distance between the flat surfaces of those elements by moving one or both of them, and to positionally fix those surfaces at desired distances from each other. In preferred embodiments, each such element that is so rendered moveable has at least two such toggle assemblies. Each toggle assembly includes an obtusely angled toggle link, one end of which is pivotally interconnected with an associated motion actuator means. A second toggle link that is positioned across the exterior angle of the angled toggle link has one end that is pivotally affixed to the angled toggle link at a first pivot point located at the angle of the angled link. The other end of the second toggle link and the other end of the angled toggle link are pivotally interconnected to the element that is to be so rendered moveable, (i.e., either or both the roll platen element or the die element, as the case may be) and with its associated mounting structure, in either order, at second and third pivot points. When such moveable element is in its most distant location from the other element to which it is juxtaposed, the first pivot point is located at one side of a straight line between said second pivot point and said third pivot point. By actuation of said motion actuator means, said first pivot point is made to move toward and substantially to said line. Optionally, stop means may be included which limits the ability of the first point to move substantially past said line.

DESCRIPTION OF DRAWINGS

This invention may be understood from the Description of Preferred Embodiments and Claims which follow, and from the accompanying drawings in which;

DESCRIPTION OF PREFERRED EMBODIMENTS

Figure 1:
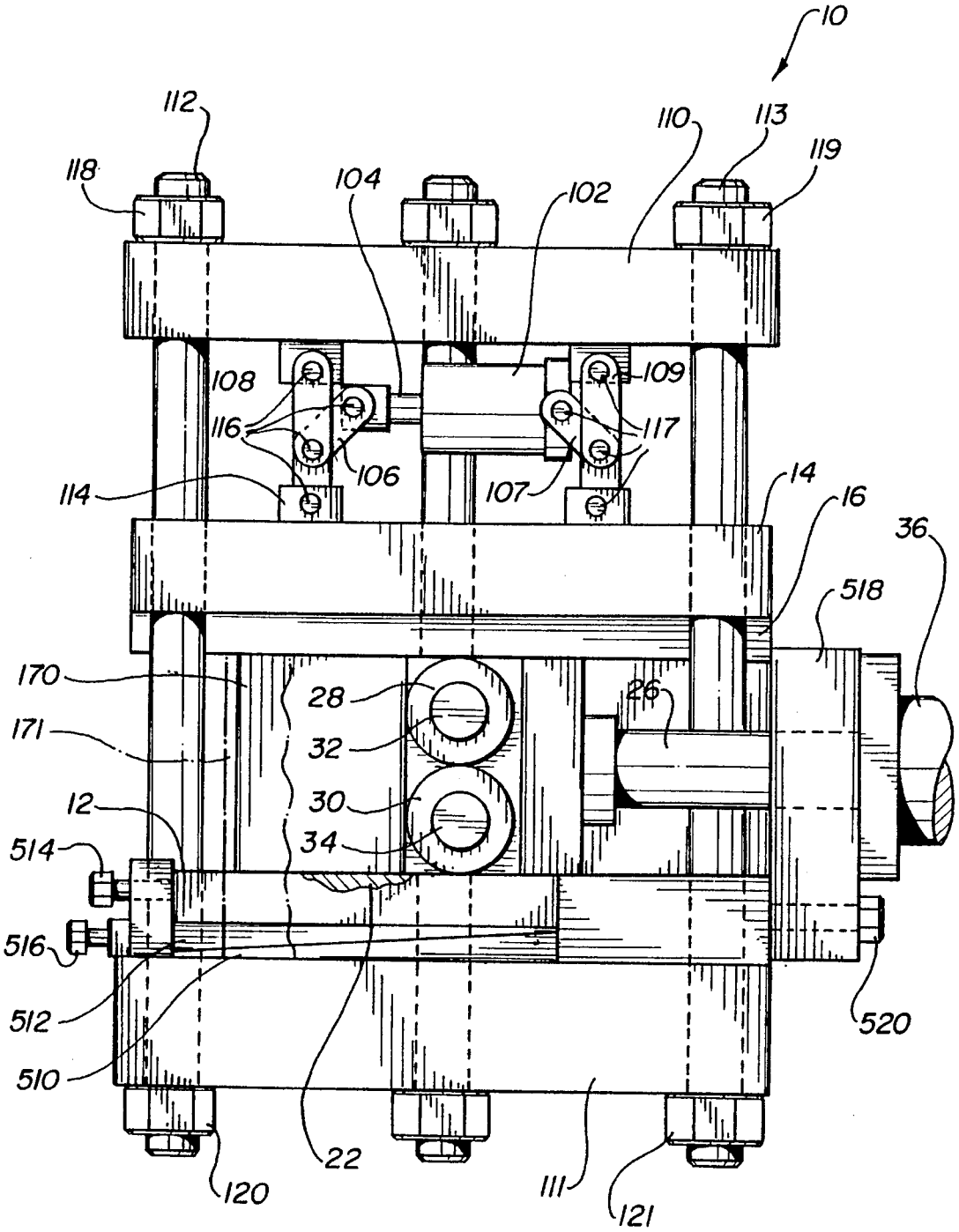
FIG. 1 is a side view of an embodiment of this invention.
Figure 3:
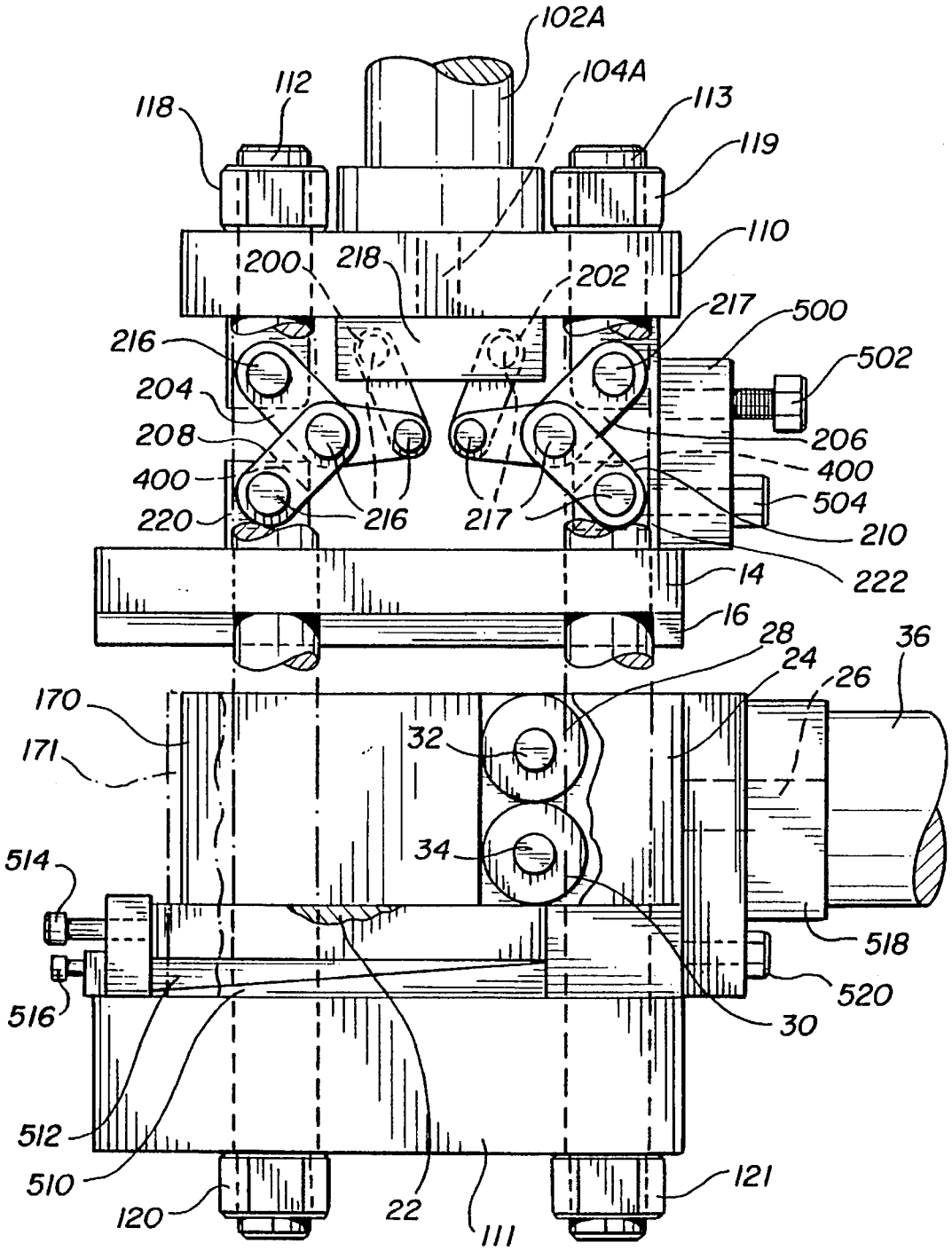
FIG. 3 is a side view of another embodiment of this invention.

Referring first to FIGS. 1 and 3, there are depicted a press-roll apparatus 100 that includes round vertical support posts 112, 113, 114, to which are positionally affixed an upper, roll platen element backer member 110 and a lower, die element backer member 111. These are referred to herein as "backer members" because, in the context of this invention, one of their principle functions is to provide reinforcement for the upper roll platen element 14 and the die element 12 to prevent them from moving when pressure is applied to the them as hereinafter described. It is to be understood, however, that these backer members also function as structural supports for the support posts of the press apparatus as a whole. The roll platen element 14, which may optionally have a roll wear surface 16, is able to slide upward and downward along the support posts 112, 114 by having the posts positioned in holes located in the ends of the roll platen element 14. The roll platen element 14 is interlinked with its associated upper backer member 112 by means of the toggle assemblies which embody this invention as hereinafter described. Thus, by proper positioning of the upper backer member 110, as by the use of circumferential size reductions and/or sleeves surrounding the support posts 112, 114 beneath the upper roll platen element 110, with the positioning bolts 118, 119 in place, operation of the toggle mechanism embodying this invention as hereinafter described may be utilized to effectuate the desired movements and positional fixing of the several apparatus components.

Similarly, the lower backer member 111 backs the die element 12 against movement when pressure is applied to the die element in a downward direction as hereinafter described. The die element 12 includes a workpiece forming surface 22 in the form of a depression into which the stock from which the workpiece is to be formed as hereinafter described. This depression may be made directly in the die element 12 or may he in the form of an insert that is mounted in the die element, with a flat top surface surrounding the die element portion that is mounted flush with the flat top surface of the then surrounding die element platen. Either configuration is referred to herein as the "die element" 12. Since, as will also hereinafter be described, it is desired to be able to adjust the working upper surface of the die element vis-a-vis the rolls 28, 30, there is provided in the apparatus shown in FIG. 1 an adjustment assembly upon which the die element 12 sits. That adjustment assembly consists of two counterdirectionally oriented wedges 510, 512, and adjustment screws 516 by means of which the juxtaposed sloping surfaces of the wedges 510, 512 may be moved relative to each other. Only one such screw 516 is shown in FIGS. 1 and 3, but it is preferable that there be two, side-by-side, so that skewing of the associated wedge piece 512 against which the inner end of the screw 516 bears, may be avoided. The effect of manipulating the elements of this assembly this is to adjust the height distance between the flat top surface of the top wedge member 512 and the flat bottom surface of the bottom wedge member 510, thus effectively raising or lowering, as the case may be, the top working surface of the die element 12. There may also optionally be included a set screw 514 for the purpose of securing the die element in place.

It is to be understood that it is within the contemplation of this invention that that toggle assemblies embodying this invention may be used in connection with either one or both of the roll platen element and the die element. Thus, such toggle assemblies may be used to replace vertical adjustment apparatus such as the wedge-type mechanisms just described, whether or not the upper roll platen element includes toggle assemblies of the types contemplated by this invention. Such alternative structures may utilize substantially the same elements, albeit adjusted in orientation as may be appropriate to the mode of use. Thus, in addition to situations where the die element is oriented with the forming die element portion facing downward and that element itself positioned above the roll platen element, the roll platen element might be stationary while the die element is rendered capable of vertical movement, upward and downward, and in either case one or bother of the elements in each instance may be rendered moveable and positionally fixable by use of toggle assemblies according to this invention.

Positioned between the flat, planar lower surface of the roll platen element and the upper, flat, planar surface of the die element is a roll set used in the forming of the workpieces. It consists of a pair of rolls 28, 30, the axes 32, 34 respectively of which are oriented parallel and substantially vertically with respect to each other. The rolls are retained in that position, and are rendered horizontally moveable, by being mounted in a roll yoke 24 that is connected to the outer end of the piston rod 26 of a horizontally oriented hydraulic cylinder 36. Since, with the rolls 28, 30 in vertical, contacting alignment with each other and with the flat surfaces of the two (roll platen and die) elements, it is substantially frictionless, the roll set may be moved laterally by the horizontal hydraulic cylinder 36 and its associated piston rod 26 with very little expenditure of work over and above that which it is necessary to do the actual forming of the workpiece.

Figure 2:
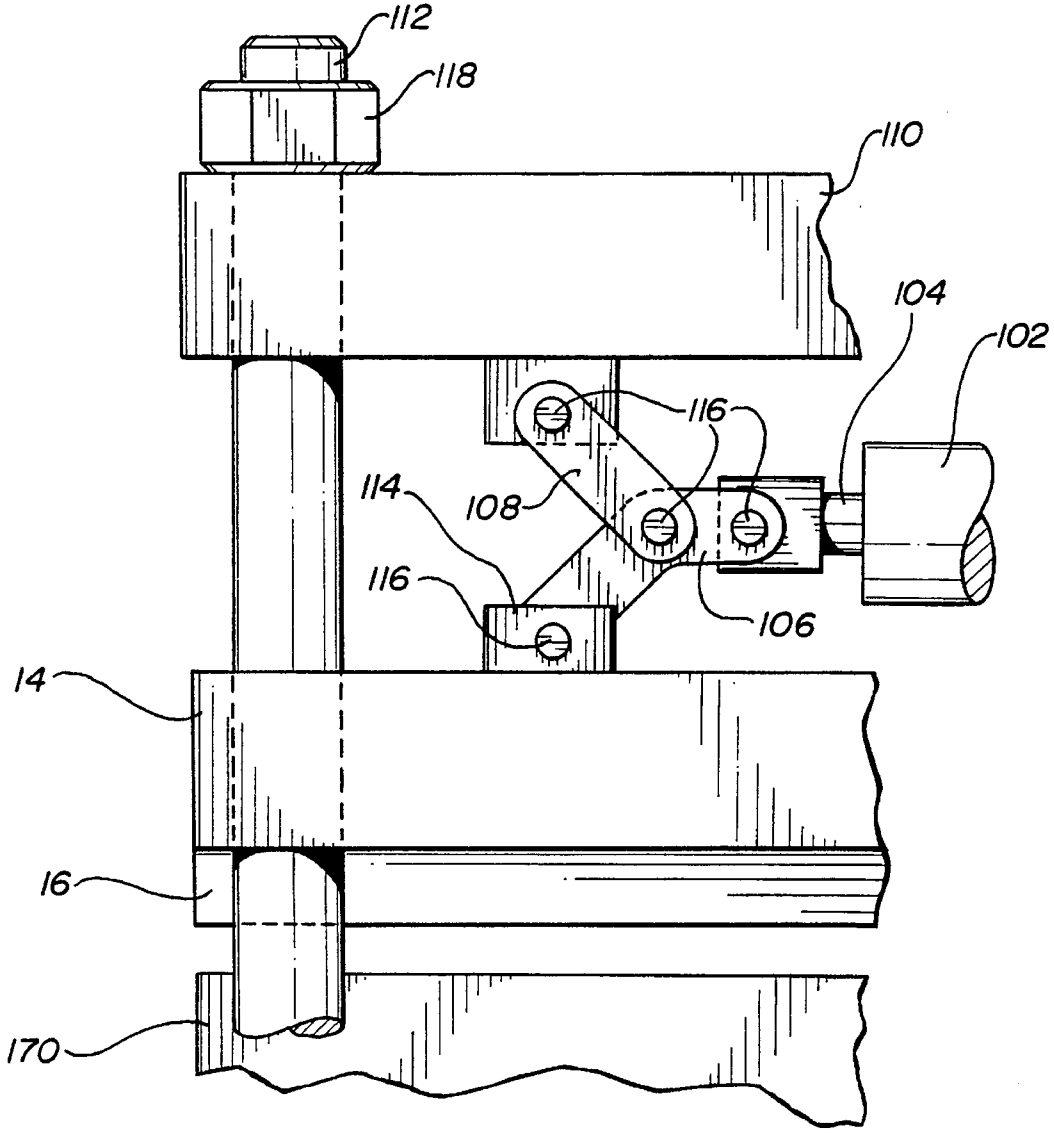
FIG. 2 is another side view of the embodiment of this invention shown in FIG. 1.

FIG. 2 illustrates a portion of the embodiment of this invention as is shown in FIG. 1 except with the toggle mechanism embodying this invention in the "open" position rather than in the "closed" position shown in FIG. 1. That is, in FIG. 2, the several components of this toggle assembly which produces relocation of the roll platen element 14 are so positioned as to have raised it up to its most distant position away from the die element 12. The mechanism includes an angled toggle link 106, one end of which is pivotally interconnected via a pivot pin 116 with the associated toggle actuation means which, in this case, is in the form of the piston rod 104 of a horizontally oriented hydraulic cylinder 102. In the region of the angle in the angular link 106, one end of a second link 108 is pivotally affixed, via a pivot pin 116, to the angled toggle link 106, thus forming there a first pivot point. The other end of the angled toggle link 106 is pivotally interconnected, by means of another pivot pin 116, with the roll platen element 14, thus forming a second pivot point. The other end of the second toggle link 108, also via a pivot pin 116, is pivotally affixed to the roll platen element backing member 110, thus forming a third pivot point.

Comparing the toggle assembly as shown in FIG. 2 with the same assembly as it appears at the top left of FIG. 1, the relative position of the constituent toggle links and their associated pivot points may be seen when the toggle assembly has been actuated, respectively, into the "open" position hereinbefore described, and in the "closed" position; i.e., when the roll platen element 16 is positioned closest to the die element 14. It will be noted that in both the "open" and "closed" positions, a straight line may imagined between the second and third pivot points. When the toggle assembly is in the "open" position shown in FIG. 1 with the associated hydraulic cylinder piston 104 withdrawn into the hydraulic cylinder 102, the first pivot point resides to one side of that line (in FIG. 2, to the right of the line). In FIG. 1, however, with the toggle assembly in the "closed" position due to the hydraulic cylinder 102 having been actuated and the piston 104 as a result having moved to its extended position, the first pivot point has moved toward and to that line. This resulted because as the outermost end of the hydraulic cylinder piston 104 moves from right to left, the angled toggle link 106 pivots about the second pinion point (i.e., the one with the roll platen element 14) causing the first pinion point to move upward along an arc and further away from the roll platen element 14. This, in turn, causes the second toggle link to be pushed upward and to become increasingly oriented more nearly vertical, combining its realignment with that of the second pivot point end of the angled toggle link to push the roll platen element 14 farther away from its associated backing member 110 and correspondingly closer to the associated die element 12. Optimally, the motion stops when the center axis of the first pivot point is exactly at the straight line between the second and third pivot points. Then counter pressure introduced to the roll platen element by the work being done on a workpiece as it is being formed will be transferred by compression on the second toggle link and the segment of the angled toggle link that is between the first and second pivot points, via the three pivot points to the backing member 110. As a practical matter, however, it is at best very difficult to do so exactly, so that it is to be expected that such counter pressure can have the effect of tending to buckle the combination of the two toggle link where they are pivotally joined at the first pinion point. In that event, positional stability of the roll platen element is dependent upon the ability of the hydraulic cylinder to to resist the buckling phenomenon. This, however, is not an insurmountable difficulty, since the arrangement will be sufficiently stable against such buckling if the three pinion points are substantially aligned with each other. That can be achieved with a comparatively small amount of work by use of the hydraulic cylinder as shown in FIG. 1, since its task at that stage is only to provide sufficient forces to stabilize the pinion point rather than having to counter the entire work load being placed on the roll platen. Another, or additional, alternative is to make it possible for the toggle links effectively to perform most, if not all, of the positional stabilization function. To that end, as additional assurance against any such buckling taking place and against the positioning of the associated platen not remaining fixed, in any of the embodiments of this invention, stop mechanisms may also or alternatively be incorporated. One example of such a stop mechanism is that type shown as stop surface 400 in FIGS. 3 and 4. In that form, when the toggle assembly is in the "closed" position, the portion of the angled toggle between the first pivot point and the point of pivotable interconnection with the toggle actuation means comes into abutment with the stop surface 400 that is incorporated into the surface of the second toggle link that abuts the angled toggle link.

Figure 4:
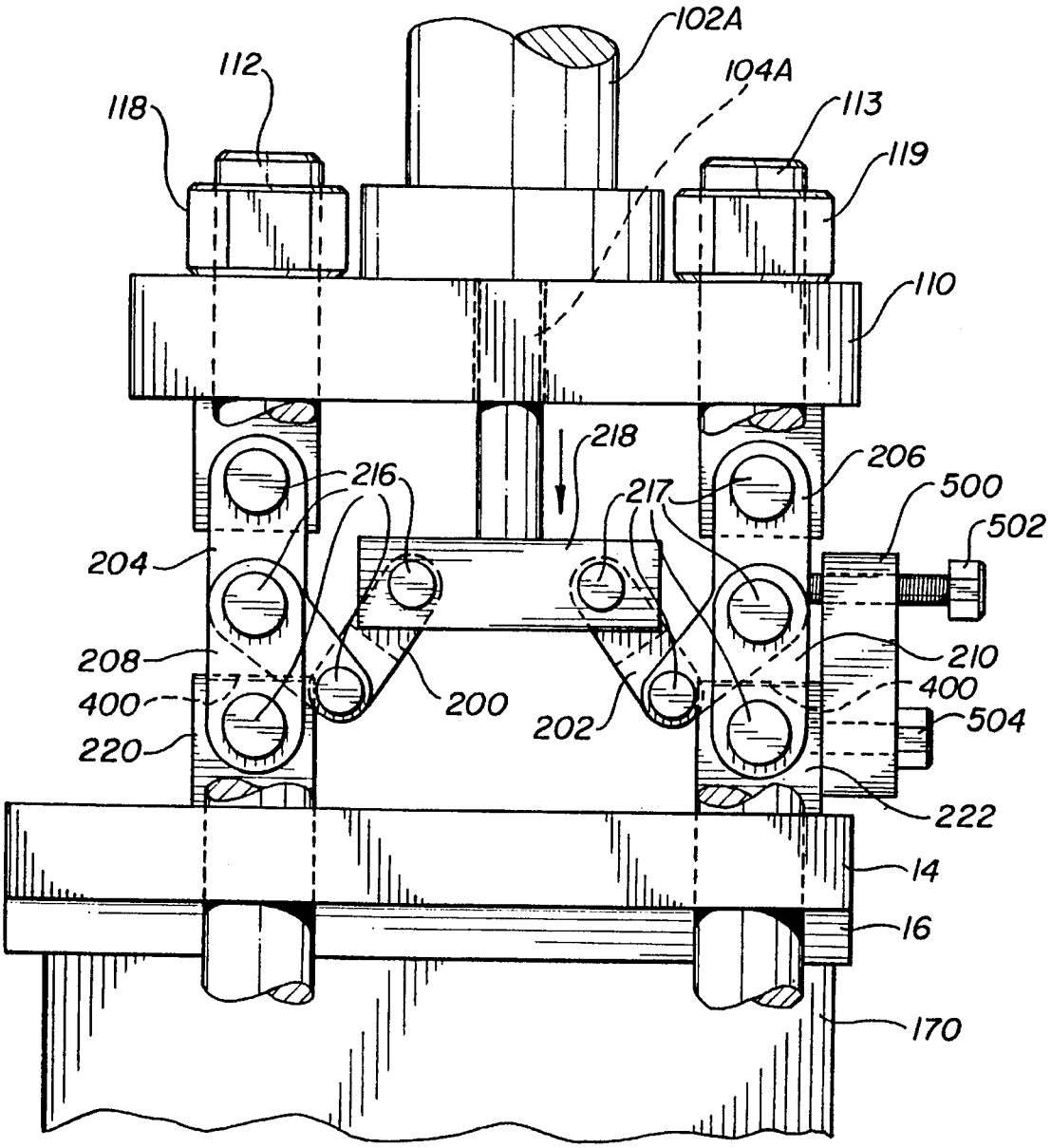
FIG. 4 is another side view of the embodiment of this invention shown in FIG. 3.

An alternative or additional form of stop assembly for these purposes is also shown in FIGS. 3 and 4, which is particularly advantageous because it provides capability for adjustment to accommodate wear, to regulate with precision the positioning of the links as hereinafter described, etc. It includes a stop body 500 that is bolted by means of bolts 504 in fixed position to the mounting block 222 on the roll platen member. It includes a set screw 502 by means of which the toggle links may effectively be blocked against moving too far past the line of alignment of the pivot points of the links. This assembly has the-additional advantage of being effective to prevent buckling as between the toggle links even with the first pivot point having moved slightly past the alignment line between the other two pivot points. By this means, the imposition of pressure upward on the roll platen element can be made to cause the assembly to become more stable since a slight buckling action, blocked by the set screw 502, will stabilize the assembly with the toggle links taking the forming pressure as compression loading on the links. Thus, it can be advantageous to have the pivot point which joins the links move slightly past the line between the centers of the second and third pinion points because in that way, pressure applied to the associated platen will have the effect of surely fixing the entire mechanism positionally since the resulting pressure of the angled toggle surface on the stop surface is a positive assurance against any buckling occurring of the type heretofore described without the necessity of any work at all being done by the toggle actuation means to stabilize the first pivot point against buckling. Of course, it is also possible by these means to align the pivot points truly so that little or no work is necessary by such things as an associated hydraulic system to positionally stabilize the apparatus. Thus, it is within the contemplation of this invention that the toggle links needs only to be more or less aligned along a straight line. Therefore, an apt description is that the first pinion point moves toward a straight line joining the other two pinion points until it becomes positioned "substantially" on that line. Thus in the context of this invention, the term "substantially" as used herein is intended to mean that although the condition or state of affairs to which that term refers is not or may not be literally totally so, any variance therefrom does not materially adversely affect the desired effect what would result but for that variance. Such stop surfaces and mechanisms may be utilized on any embodiments within the contemplation of this invention including (without limitation) those shown in all of FIGS. 1 through 4 inclusive, and may be of any of a wide variety of forms and/or configurations as will be within the knowledge of those skilled in the art.

It should be noted that as shown in FIG. 1, there is a "mirror image" toggle assembly to that previously discussed that is positioned above the other end of the roll platen element 14, with the actuation means end of the angled toggle link pivotally affixed to the main hydraulic cylinder 102 at the end opposite that from which the piston rod 104 extends. It is usually desirable, although not essential, to provide more than one toggle assembly-for each platen (roll platen, die element platen, etc.) that is to be rendered moveable, because this distributes work loads more effectively and provides greater assurance that the platen being regulated will be more stable positionally. An advantage of the arrangement illustrated in FIG. 1 is that utilizes a single cylinder to actuate both assemblies simultaneously since forces created by the extension of the hydraulic cylinder piston rod 104 concurrently and substantially equally act on both the cylinder 102 and its piston rod 104.

From the foregoing description, it will be clear how the apparatus works. With the roll set retracted so that the forming surface of the die element is accessible, work piece stock is retentively located in the region of the forming surface. The toggle assembly actuator means is actuated, causing the angled toggle link in each assembly to pivot and to cause its associated second link to pivot also. This causes the first pivot point to move toward the line between the other two pivot points until it is substantially on that line. At that point, the outside edges of the roll platen element rest on the top edges of side frame members 170, 171. Thereafter throughout the forming cycle, the toggle assembly is stabilized as previously described against further movement, so that the associated assemblies are effectively fixed or locked positionally against yielding to pressure brought to bear on the platen as the roll set is moved forward and backward and work pieces are formed. At any time when formation is not under way, access may be gained to the working surfaces of the platens, forming dies, roll and roll sets, workpieces, etc. as desired, by reversing the toggle actuation means,thus reopening the platens with respect to each other.

FIGS. 3 and 4 illustrate another embodiment of this invention, with the associated platens in the "open" and "closed" positions respectively. As such, the various components of the press are more or less the same as in the embodiments previously discussed, and so corresponding elements are number-designated the same as previously where there is such correspondence of elements. However, the toggle linkages and toggle actuator arrangements are somewhat different, thus representing another embodiment of this invention, and illustrating that this invention may be practiced in a wide variety of embodiments without departing from its spirit or scope. Again, two toggle assemblies are shown to move and positionally fix one element. Of course, as has been pointed out with respect to other embodiments of this invention, one or more such assemblies may also or alternatively be utilized to move and positionally fix a lower positioned element (whether that is the roll platen element or the die element), merely by reorienting the various constituents of the assemblies.

The embodiments as shown in FIGS. 3 and 4 have a single toggle link actuator means with associated angular and second toggles that are pivotally interlinked with each other, their associated elements and backing members, and the associated toggle actuation means substantially as hereinbefore described. Here, however, the hydraulic cylinder 102A and its piston rod 104A are oriented vertically and face downward, with the outermost end of the piston rod 104A extending through the backing member 110 to connect with a crosshead member 218. In turn, the ends of the crosshead 218 are pivotally interlinked by pivot pins 216, 217 with one end of connecting links 200, 202, the other ends of which are pivotally interlinked by pivot pins 216,217 with the free ends of their associated angled toggles 204, 206. Thereby motion is transferred from the piston 104A of the hydraulic cylinder 102A when it is actuated to the angled toggles 204, 206 via the crosshead 218. In this sense, then, this sequence of elements from the hydraulic cylinder through the connecting links 200, 202 constitutes the actuation means for these embodiments of this invention; and the nature and operation of the remaining elements of the toggle assembly being substantially comparable to those previously described. An advantage of this embodiment is that it provides greater assurance that the motion of the elements constituting both toggle assemblies will be substantially identical. Thus, this embodiment further illustrates the wide variety of embodiments that may be made within the contemplation of this invention.

Accordingly, it is to be understood that the embodiments of this invention herein illustrated and discussed are by way of illustration and not of limitation, and that a wide variety of embodiments may be made without departing from the spirit or scope of this invention.

I claim:

1. For use in forming apparatus having a die element and a roll platen element, each of which has an associated mounting structure and each of which has a flat surface which is parallel to and faces that of the other element, at least one toggle assembly to move at least one of said elements and thereby to change the distance between said surfaces comprising an obtusely angled toggle link, the obtuse angle of which forms an angle of more than 180 degrees along one side of said link, one end of which toggle link is pivotally interconnected with an associated motion actuator means, a second toggle link that is positioned across said exterior angle of said angled link, one end of said second link being pivotally affixed to said angled toggle link at a first pivot point located at said obtuse angle of said angled link, the other end of said second toggle link and the other end of said angled toggle link being pivotally interconnected, one each, with said element and its associated mounting structure at second and third pivot points said first pivot point, when the elements are in their most distant location from each other, being located at one side of a straight line between said second pivot point and said third pivot point and, by actuation of said motion actuator means, being moveable at least substantially to said line, and a stop body integral with the structure of said apparatus that is adapted to restrict said toggle link and said angled toggle from moving said first pivot point by more than a predetermined distance past said line.

2. The apparatus described in claim 1 comprising at least two toggle mechanisms as described, that are pivotally interlinked as described with said element and with its backing member.

3. The apparatus described in claim 1 wherein said toggle mechanism actuation means is a hydraulic cylinder actuated piston rod.

4. The apparatus described in claim 2 wherein said toggle mechanism actuation means is a hydraulic cylinder actuated piston rod.

5. The apparatus described in claim 1 wherein said pivot means by which said toggle mechanism actuation means is pivotally interconnected with said end of said angular toggle link comprises a third toggle link.

6. The apparatus described in claim 2 wherein said pivot means by which said toggle mechanism actuation means is pivotally interconnected with said end of said angular toggle link comprises a third toggle link.

7. The apparatus described in claim 3 wherein said pivot means by which said toggle mechanism actuation means is pivotally interconnected with said end of said angular toggle link comprises a third toggle link.

8. The apparatus described in claim 4 wherein said pivot means by which said toggle mechanism actuation means is pivotally interconnected with said end of said angular toggle link comprises a third toggle link.

* * * * *